United States Patent [19]

Masaki

[11] Patent Number: 4,888,864

[45] Date of Patent: Dec. 26, 1989

[54] APPARATUS FOR MOUNTING CABLE ON A CONNECTOR

[75] Inventor: Takashi Masaki, Tokyo, Japan

[73] Assignee: Hirose Electric Co., Ltd., Tokyo, Japan

[21] Appl. No.: 357,129

[22] Filed: May 26, 1989

[30] Foreign Application Priority Data

Aug. 17, 1988 [JP] Japan ..... 63-203159

[51] Int. Cl.[4] ..... H01R 43/04

[52] U.S. Cl. ..... 29/753; 29/715; 29/759

[58] Field of Search ..... 29/714–718, 29/748, 753, 754, 759

[56] References Cited

FOREIGN PATENT DOCUMENTS 57-182988 11/1982 Japan .

*Primary Examiner*—Carl E. Hall

*Attorney, Agent, or Firm*—Kanesaka & Takeuchi

[57] ABSTRACT

A machine for mounting a plurality of conductors of a multiconductor cable on a plurality of contacts or connection grooves of a connector, which includes a connector holder secured on a top surface of the base section to hold a connector having a row of connection grooves or contacts and a conductor carrier rotatable about an axis perpendicular to a top surface of the base and movable along the axis and the vertical plane. The conductor carrier includes a carrier arm provided on the conductor carrier for reciprocating movement in a direction perpendicular to the vertical plane; two pairs of fingers, one provided on the conductor carrier and the other on the carrier arm, to pick up the conductor from the receiving groove and bring it over to a position above a desired connection groove or contact of the connector; and a pusher provided adjacent one of the pair of fingers for reciprocating movement along the vertical axis to insert the conductor into the desired connection groove or contact.

2 Claims, 1 Drawing Sheet

APPARATUS FOR MOUNTING CABLE ON A CONNECTOR

BACKGROUND OF THE INVENTION

The present invention relates generally to machines for mounting a multiconductor cable on a connector and, more particularly, to a machine for mounting individual conductors of a multiconductor cable on corresponding connection grooves or contacts of a connector for connection by pressure.

Japanese Patent Application Kokai No. 57-182988 disclosed a machine which includes a pair of longitudinal rollers spaced apart at the distance of a conductor diameter between which a number of conductors are aligned side by side; a ram for pushing the conductors out of the rollers one by one; and a disc with a notch provided at the lower ends of the longitudinal rollers so that one conductor is moved for each rotation of the disc.

A pair of lateral rollers are provided below the longitudinal rollers to hold a conductor between them applying tension to it. A transfer arm with a V-shaped notch is provided so as to reciprocate through an arced slot provided on the disc. A connector is placed at a position adjacent the front of the transfer arm and is moved by pitch, with a multiconductor cable held in the vicinity.

In the above machine, when the notch of the disc corresponds to the lower ends of the rollers, one conductor is received in the notch and moved by a half circle by rotation of the disc. The front end of the conductor is then held between the lateral rollers and pulled downwardly for stretching in the diametrical direction of the disc. When the transfer arm is advanced through the arced slot of the disc, the V-shaped notch brings the conductor to the desired position. The conductor is then inserted into the desired connection groove of the connector by an insertion device which is provided beside the connector. In response to the conductor identification signal, the connector is moved so that the desired connection groove is positioned below the insertion device.

In the above machine, however, the conductor is transferred to the lateral rollers from the disc by making use of the hanging end portion of the conductor. Consequently, when the conductor has a short hanging portion or bent portion, the lateral rollers can fail to catch it, which in turn causes the transfer arm to fail to bring the conductor to the desired position. In addition, even when the lateral rollers catch the hanging portion, the transfer arm can fail to bring the conductor to the desired position.

Since the multiconductor cable is held along the longitudinal direction of the connector, it is impossible to position the cable at the center of the connector but either end of the connector, requiring a special connector case.

SUMMARY OF THE INVENTION

Accordingly, it is an object of the present invention to provide an apparatus for mounting a cable on a connector which is reliable and accurate in operation and positioning of individual conductors.

According to the invention there is provided a apparatus for mounting a plurality of conductors of a multiconductor cable on a plurality of contacts of or a plurality of connecting grooves of a connector, which includes a connector holder for holding the connector such that the contacts or connection grooves are exposed; a cable holder provided adjacent the connector holder for holding the multiconductor cable; a receiver unit provided adjacent the connector holder, the receiver unit having a receiver slit extending downwardly from a top surface of the receiver unit and having a width substantially equal to a conductor diameter for receiving the conductors aligned side by side in a vertical plane parallel to the connector holder; and a biasing plate provided at a bottom of the receiver slit for biasing upwardly the aligned conductors; a transfer unit provided on the receiver unit for reciprocating movement in a direction perpendicular to the vertical plane and having a transfer groove extending along the vertical plane for moving a single top conductor in the receiving slit; a receiving groove provided on the top surface along the vertical plane for receiving a conductor when the transfer unit is moved to an advanced position; a sensor provided on the receiver unit such that it contacts a wire of the conductor held in a space defined between the transfer groove and the receiving groove to generate a conductor number signal; a pair of escapement slots extending in a direction perpendicular to the vertical plane and downwardly from the top surface by a distance greater than the conductor diameter; a clamp unit with clearance recesses for receiving a front end of the transfer unit to hold the conductor in place in the receiving groove when the transfer unit is moved to the advanced position; a carrier unit with a frame rotatable about a shaft parallel to the vertical plane and movable in each direction of a rectangular coordinate system and having an arm for reciprocating movement; two pairs of fingers, one provided on the frame and the other provided on the arm, each pair being able to enter each escapement slot to hold the conductor between the fingers when the clamp unit holds the conductor and the transfer unit is moved to a retreated position; a pusher unit provided on the carrier unit adjacent one of the finger pairs and movable along the shaft to push the conductor into the contact or connection groove of the connector; and a control unit in response to the conductor number signal to move the fingers so that the conductor is placed above a desired contact or connection groove and inserted thereunto by the pusher unit to thereby mount the conductor on the connector.

According to the invention, a multiconductor cable may be mounted on a connector as follows.

(1) Desired lengths of individual conductors of a multiconductor cable are separated, and the multiconductor cable is held in place by the cable holder. The individual conductors are then placed in the receiver slit side by side. The biasing plate pushes up the conductors so that the top conductor is pressed against the transfer plate.

(2) When the transfer plate is advanced, the conductor is transferred into the receiving groove. The clamp plate then holds the conductor in the receiving groove, and the transfer plate is returned to the original position.

(3) Two pairs of carrier fingers are lowered into the escapement slots to hold the conductor at two points, and the clamp plate is opened.

(4) When the clamp plate presses the conductor against the receiver groove, the sensor needle comes into contact with the wire of the conductor to identify the conductor number. In response to the identification signal, the conductor carrier is brought to the desired connection groove of a connector.

(5) While the conductor carrier is brought to the desired position, the two pairs of fingers are separated further to stretch the conductor.

(6) When the carrier fingers bring the conductor to the desired connection groove or contacts, the conductor is inserted into the connection groove or contacts by the insertion device. The above steps are repeated to mount all the conductors on the connector.

Other objects, features, and advantages of the invention will be apparent from the following description taken in conjunction with the accompanying drawings.

DESCRIPTION OF THE PREFERRED EMBODIMENT

Figure 1:
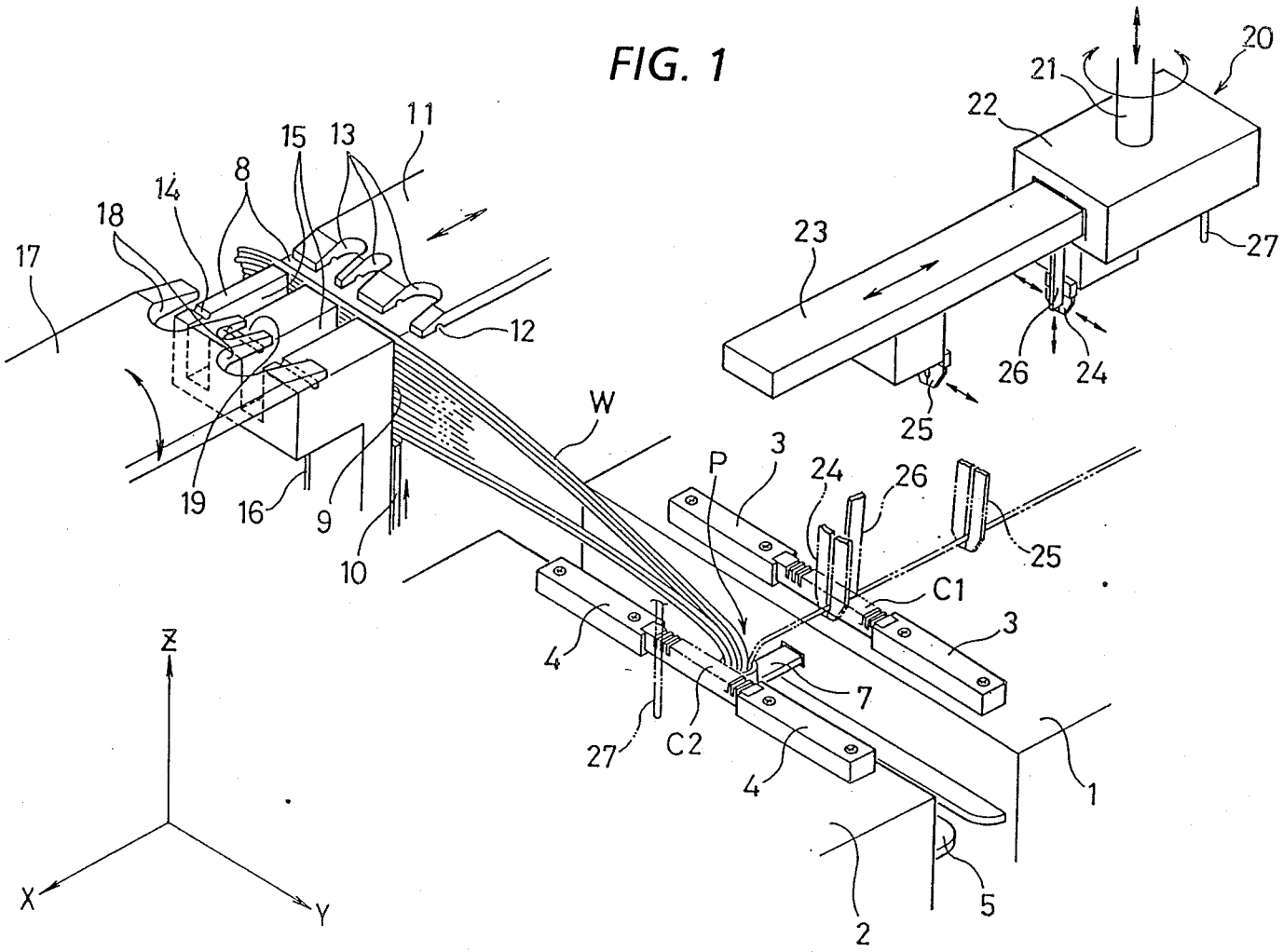
FIG. 1 is a perspective view of a machine for mounting a cable to a connector according to an embodiment of the invention.

FIG. 1 shows a machine for mounting a cable on a connector according to an embodiment of the present invention. A rectangular coordinate system XYZ is given to help clarification of directions. This machine includes a pair of base sections 1 and 2 spaced apart along the X axis. A pair of connector holders 3 or 4 are provided on the top edge portion of each base section 1 or 2 along the Y axis so that an elongated connector is positioned along the Y axis. These connector holders 3 or 4 are movable along the Y axis and interchangeable with other types according to the size and type of a connector. A guide plate 5 with a U-shaped recess for guiding a multiconductor cable P is provided between the base sections 1 and 2. A cable holder 7 is provided so as to be movable in the X direction and holds by pressure the cable P when it is positioned at the bottom of the U-shaped recess.

A receiver block 8 is provided behind the base blocks 1, 2 and has a receiver slit 9 extending downwardly from the top surface of the receiver block 8 in a Y-Z plane. The widths of the slit 9 in the X direction is made substantially equal to the diameter of a conductor. The conductor herein used means an insulated wire. A pusher plate 10 is provided at the bottom of the slit and biased upwardly in the Z direction by a compression spring or the like (not shown).

A transfer plate 11 is provided on the right side of the slit 9 for sliding movement on the top surface of the receiver block 8. This transfer plate has on the front sliding surface a transfer groove 12 extending in the Y direction so as to receive a conductor and U-shaped recesses 13 for meshing with the U-shaped recesses of a clamp plate which will be described later.

A receiving groove 14 is provided on the top of the receiver block 8 on the left side of the slit 9 for receiving a conductor. It is positioned such that when the transfer plate 11 is advanced, the transfer groove 12 registers with the receiving groove 14. The tip of a sensor needle 16 projects into the receiving groove 14. This sensor needle 16 is connected to a connection sensor (not shown) so that when it penetrates the insulation of a conductor and contacts the wire, the conductor number is identified. Alternatively, the connection sensor may employ a clip for contact with the wire of a conductor. A pair of escapement slots 15 are provided on the receiver block 8 at right angles with the receiving groove 14 and have a depth greater than that of the receiving groove 14.

A clamp plate 17 is provided for rotation between open and closed positions. In the closed position, it holds a conductor in the receiving groove 14. It has a pair of clearance recesses 18 at positions corresponding to the escapement slots 15 and a U-shaped cut 19 between the clearance recesses 18 so that the front end of the transfer plate 11 meshes with the clamp plate 17.

A conductor carrier 20 is provided above the base blocks 1, 2 for rotation about a shaft 21 extending along the Z axis by a predetermined angle (90 degrees in this embodiment) and three-dimensional movement by a given distance in the rectangular coordinate system. This distance to the connection groove of a connector is determined by a controller in response to the conductor number identified by the sensor 16.

A carrier arm 23 is mounted on a carrier frame 22 of the conductor carrier 20 for reciprocating movement along the X axis. A pair of fingers 24 or 25 extend downwardly from the carrier frame 22 or the carrier arm 23 for holding a conductor between them. A pusher bar 26 is provided adjacent the fingers 24 for reciprocating movement along the Z axis. A regulator needle 27 extends downwardly from the frame 22 to prevent the fingers 24, 25 but the pusher bar 26 from descending below the top of connector when the conductor held by the fingers 24, 25 is brought into a position just above the connection groove of a connector.

A method of mounting a multiconductor cable on a connector with the above machine will be described.

(1) A described length of sheath at either end of a multiconductor cable P, which consists of a number of insulted wires W bundled within the sheath, is cut off to separate respective conductors. One end of the cable P is held by the cable holder 7 through the sheath. The respective conductors W are inserted in the receiver slit 9. At this point, the transfer plate 11 is held at a retreated position. When released, the transfer plate 11 is advanced to such an extent that the transfer groove 12 comes in agreement with the receiver slit 9. Consequently, the top conductor in the receiver slit 9 is pushed into the transfer groove 12 by the pusher plate 10.

(2) The transfer plate 11 is then further advanced in the X direction until the transfer groove 12 reaches the receiving groove 14 while the clamp plate 17 is hinged downwardly to hold the conductor. The transfer plate 11 is then returned to the middle position where the transfer groove 12 registers with the receiver slit 9.

(3) The two pairs of fingers 24, 25, which are held above the receiver slots 15, are then lowered into the receiver slots 15 to hold the conductor between the fingers. Then, the clamp plate 17 is hinged upwardly so that the fingers 24, 25 can pick up the conductor.

(4) The fingers 24, 25 are moved upwardly and then laterally in a X-Y plane to a position above the desired groove of a connector block C1 (or C2) while they are spaced further apart from each other to stretch the conductor, so that they are positioned across the connector block C1. The above positioning is controlled in response to the conductor number identified by the sensor 16.

(5) The fingers 24, 25 are then lowered until the regulator needle 27 hits the base section 1, when the conductor is on the desired connection groove. Then, the pusher 26 is lowered to insert the conductor into the connection groove.

(6) The above steps are repeated for each conductor. When all the conductors W are attached to the connector block C1, the connector block is joined to a connector body (not shown) with a number of contacts by means of a press to connect by pressure the conductors to the contacts both mechanically and electrically.

(7) The finished connector is then connected to a connection detector (not shown), and the other end of the cable is held between the base sections 1, 2 by the cable holder 7. As described above in the steps (1) and (2), individual conductors W are placed in the receiver slit 9 of the block 8. The top conductor is then moved by the transfer plate 11 into the receiving groove 14 and held in place by the clamp plate 17.

(8) Then, the sensor needle 16 is moved upwardly to penetrate the insulation of the conductor for contact with the wire so that the connection detector identifies the conductor number to generate a signal for driving the conductor carrier 20. That is to say, the fingers 24, 25 pick up and bring the conductor to the connector block C1 (or C2) so that the conductor is inserted into the desired connection groove of the connector block.

(9) The above steps are repeated to mount the other conductors on the connector block C1 or C2, which is then joined to a connector body by means of a press, thus providing the cable terminated with a pair of the connectors.

Alternatively, one or three or more connectors may be connected to a cable. The direction where conductors are inserted into a connector block may be set at a given angle to the direction where the receiver slit receives conductors. The connector block may be replaced with a connector body with a number of contacts to which conductors are directly connected by insulation displacement techniques for example.

According to the invention, since a conductor is brought to the desired connection groove of a connector block by the carrier fingers and inserted thereunto by the elongated pusher, the operation is very reliable, and the individual conductors may be branched to a few connectors.

While a preferred embodiment of the invention has been described using specific terms, it is to be understood that changes and variations may be made without departing from the spirit and scope of the invention as recited in the appended claims.

What is claimed is:

1. Apparatus for mounting a plurality of conductors of a multiconductor cable on a plurality of contacts or connection grooves of a connector, which comprises:

a connector holder for holding said connector such that said contacts or connection grooves are exposed;

a cable holder provided so as to hold said multiconductor cable adjacent said connector;

receiver means provided behind said connector holder, said receiver means including:

a receiver slit extending along a longitudinal axis of said connector and downwardly from a top surface of said receiver means and having a width substantially equal to a conductor diameter for receiving said conductors aligned side by side in a vertical plane along said longitudinal axis; and biasing means provided at a bottom of said receiver slit for biasing upwardly said aligned conductors;

transfer means provided on said receiver means for reciprocating movement in a direction perpendicular to said vertical plane and having a transfer groove extending parallel to said vertical plane for moving a single top conductor from said receiving slit;

a receiving groove provided on said top surface extending parallel to said vertical plane for receiving a conductor when said transfer means is moved to an advanced position;

a sensor provided on said receiver means such that it contacts a wire of said conductor held in said receiving groove to generate a conductor identification signal;

a pair of escapement slots extending in a direction perpendicular to said vertical plane and downwardly from said top surface by a distance greater than said conductor diameter;

clamp means with clearance recesses for receiving a front end of said transfer means to hold said conductor in said receiving groove when said transfer means is moved to said advanced position;

carrier means with a frame rotatable about a vertical axis and movable in each direction of a rectangular coordinate system and having an arm for reciprocating movement in a direction perpendicular to said vertical plane;

two pairs of fingers, one provided on said frame and the other provided on said arm, each pair being able to enter each escapement slot to hold said conductor between said fingers when said clamp means holds said conductor, and said transfer means is moved to a retreated position;

pusher means provided on said carrier means adjacent one of said finger pairs for reciprocating movement along said vertical axis to push said conductor into said contact or connection groove of said connector; and control means in response to said conductor identification signal to move said fingers so that said conductor is placed above a desired contact or connection groove and inserted thereunto by said pusher means to thereby mount said conductor on said connector.

2. Apparatus for mounting a plurality of conductors of a multiconductor cable on a plurality of contacts or connection grooves of a connector, which comprises:

a pair of base sections spaced apart from each other;

a connector holder secured on a top surface of at least one of said base sections to hold a connector having a row of connection grooves or contacts;

a cable guide provided between said base sections and having a U-shaped recess;

a cable holder provided in said base section for reciprocating movement in a direction perpendicular to a longitudinal axis of said connector to hold at its advanced position said multiconductor cable at a bottom of said U-shaped recess;

a receiver block provided behind said base sections, said receiver block including:

a receiver slit in a vertical plane along said longitudinal axis to receive said conductors arranged in said vertical plane;

biasing means provided at a bottom of said receiver slit to push upwardly said conductors;

a pair of escapement slots provided in said receiver block in parallel planes perpendicular to said vertical plane; and a receiving groove provided parallel to said vertical plane on a top surface of said receiver block on the same side as said escapement slots;

transfer means provided on top of said receiver block for reciprocating movement in a direction perpendicular to said vertical plane and having a transfer groove on its back side extending parallel to said vertical plane;

clamp means provided on top of said receiver block for movement between open and closed positions to hold a conductor in said receiving groove at said closed position and release said conductor at said open position;

a conductor carrier rotatable about an axis perpendicular to a top surface of said base and movable along said axis and said vertical plane; said conductor carrier including:

a carrier arm provided on said conductor carrier for reciprocating movement in a direction perpendicular to said vertical plane;

two pairs of fingers, one provided on said conductor carrier and the other on said carrier arm, to pick up said conductor from said receiving groove and bring it over to a position above a desired connection groove or contact of said connector; and pusher means provided adjacent one of said pair of fingers for reciprocating movement along said vertical axis to insert said conductor into said desired connection groove or contact.

* * * * *